US012661757B2

(12) United States Patent
Kwon et al.

(10) Patent No.: US 12,661,757 B2
(45) Date of Patent: Jun. 23, 2026

(54) POLISHING APPARATUS FOR A SUBSTRATE AND POLISHING METHOD FOR A SUBSTRATE USING THE SAME

(71) Applicant: Samsung Electronics Co., Ltd., Suwon-si (KR)

(72) Inventors: Donghoon Kwon, Suwon-si (KR); Boun Yoon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 461 days.

(21) Appl. No.: 18/097,540

(22) Filed: Jan. 17, 2023

(65) Prior Publication Data

US 2023/0415303 A1 Dec. 28, 2023

(30) Foreign Application Priority Data

Jun. 27, 2022 (KR) ..... 10-2022-0078208

(51) Int. Cl.
*B24B 53/017* (2012.01)
*B24B 37/24* (2012.01)

(52) U.S. Cl.
CPC ..... *B24B 53/017* (2013.01); *B24B 37/24* (2013.01)

(58) Field of Classification Search
CPC ..... B24B 7/228; B24B 37/005; B24B 37/044; B24B 37/10; B24B 37/14; B24B 37/20;
(Continued)

(56) References Cited

U.S. PATENT DOCUMENTS 6,364,744 B1 * 4/2002 Merchant ..... C09K 3/1463 451/6
7,071,108 B2 * 7/2006 Matsui ..... C09G 1/02 438/692

(Continued)

FOREIGN PATENT DOCUMENTS

JP 2003-334762 A 11/2003
JP 6145761 B2 6/2017

(Continued)

OTHER PUBLICATIONS

Reynolds, Sheila. "Quartz vs. Fused Silica" (A blog post for Swift Glass) [Online] [Retrieved on May 9, 2025]. Retrieved from:<https://www.swiftglass.com/blog/quartz-vs-fused-silica-whats-the-difference/>; Archived at Wayback Machine: <http://web.archive.org/>. Citing a capture dated May 9, 2020. (Year: 2020).*

*Primary Examiner* — Joel D Crandall
(74) *Attorney, Agent, or Firm* — Muir Patent Law, PLLC

(57) ABSTRACT

A polishing apparatus for a substrate, includes: a polishing pad having at least one region formed of a light-transmitting material; a platen on which the polishing pad is disposed on an upper surface thereof, having a groove portion in a region overlapping the polishing pad, and rotatably installed in one direction; a light source unit accommodated in the groove portion of the platen, and emitting light of a predetermined wavelength band to the one region of the polishing pad; a slurry supply unit supplying a slurry containing photocatalyst particles excited by the light of the predetermined wavelength band to the polishing pad; and a polishing head installed on the polishing pad to be spaced apart from the slurry supply unit in the one direction, and rotating a semiconductor substrate in close contact with the polishing pad.

19 Claims, 10 Drawing Sheets

(58) Field of Classification Search
CPC ..... B24B 37/205; B24B 37/22; B24B 37/24; B24B 37/26; B24B 37/32; B24B 49/04; B24B 49/045; B24B 49/10; B24B 49/12; B24B 53/017; B24B 53/02
USPC ..... 451/5, 6, 41, 60
See application file for complete search history.

(56) References Cited

U.S. PATENT DOCUMENTS

| | | | | |
|---|---|---|---|---|
| 8,912,095 | B2 | 12/2014 | Sano et al. | |
| 9,669,515 | B2 | 6/2017 | Matsuo et al. | |
| 10,076,825 | B2 | 9/2018 | Takenouchi | |
| 10,297,475 | B2 | 5/2019 | Yamauchi et al. | |
| 2001/0036804 | A1* | 11/2001 | Mueller | B24D 3/34 451/526 |
| 2002/0173225 | A1* | 11/2002 | Wang | B24B 37/013 451/6 |
| 2004/0075065 | A1* | 4/2004 | Spivak | A61N 5/0614 250/504 R |
| 2009/0170320 | A1* | 7/2009 | Heinrich | H01L 21/32125 438/692 |
| 2017/0291279 | A1* | 10/2017 | Karandikar | B24B 53/12 |
| 2022/0168866 | A1* | 6/2022 | Baba | B24B 37/20 |
| 2023/0197482 | A1* | 6/2023 | Im | H01L 21/67219 451/5 |

FOREIGN PATENT DOCUMENTS

| | | | |
|---|---|---|---|
| KR | 10-2005-0092953 | A | 9/2005 |
| KR | 101722555 | B1 * | 4/2017 |

* cited by examiner

II - II'

III-III'

IV-IV'

V-V'

VI-VI'

POLISHING APPARATUS FOR A SUBSTRATE AND POLISHING METHOD FOR A SUBSTRATE USING THE SAME

CROSS-REFERENCE TO RELATED APPLICATION(S)

This application claims benefit of priority under 35 U.S.C. § 119 to Korean Patent Application No. 10-2022-0078208, filed on Jun. 27, 2022, in the Korean Intellectual Property Office, the disclosure of which is incorporated herein by reference in its entirety.

BACKGROUND

The present inventive concept relates to a polishing apparatus for a substrate and a polishing method for a substrate using the same.

A chemical mechanical polishing (CMP) process is a process of planarizing a surface of a substrate by combining a mechanical polishing effect of an abrasive and a chemical reaction effect of an acid or a base solution.

Such a CMP process is used for planarization of various materials such as, for example, an interlayer dielectric (ILD), a polishing process of a silicon oxide film for the purpose of shallow trench isolation (STI), a forming process of a tungsten (W) plug, and a copper wiring process.

SUMMARY

An aspect of the present inventive concept is to provide a polishing apparatus for a substrate and a polishing method for a substrate capable of adjusting a polishing rate in a CMP process.

According to an aspect of the present inventive concept, a polishing apparatus for a substrate is provided, the polishing apparatus including: a polishing pad formed of a light-transmitting material; a platen on which the polishing pad is disposed on an upper surface thereof, the platen having a groove portion in a region overlapping the polishing pad, and being rotatably installed in one direction; a slurry supply unit configured to supply a slurry containing photocatalyst particles excited by light of a predetermined wavelength band to the polishing pad; a light source unit accommodated in the groove portion of the platen, and configured to emit light of the predetermined wavelength band; a conditioner installed on the polishing pad to be spaced apart from the slurry supply unit in the one direction, and configured to polish a surface of the polishing pad; and a polishing head installed on the polishing pad to be spaced apart from the conditioner in the one direction, and configured to rotate the substrate in contact with the polishing pad.

According to an aspect of the present inventive concept, a polishing apparatus for a substrate is provided, the polishing apparatus including: a polishing pad having at least one region is formed of a light-transmitting material; a platen on which the polishing pad is disposed on an upper surface thereof, the platen having a groove portion in a region overlapping the polishing pad, and being rotatably installed in one direction; a light source unit accommodated in the groove portion of the platen, and configured to emit light of a predetermined wavelength band to the one region of the polishing pad; a slurry supply unit configured to supply a slurry containing photocatalyst particles excited by light of the predetermined wavelength band to the polishing pad; and a polishing head installed on the polishing pad to be spaced apart from the slurry supply unit in the one direction, and configured to rotate the substrate in contact with the polishing pad.

According to an aspect of the present inventive concept, a polishing apparatus for a substrate is provided, the polishing apparatus including: a platen on which a polishing pad formed of a light-transmitting material is disposed on an upper surface thereof, and rotatably installed in one direction; a light source unit accommodated in a groove portion formed on an upper surface of the platen, and configured to emit light of a predetermined wavelength band toward the polishing pad; and a slurry supply unit configured to supply a slurry containing photocatalyst particles excited by the light of the predetermined wavelength band to the polishing pad.

According to an aspect of the present inventive concept, a polishing method for a substrate is provided, the polishing method including: an operation of disposing the substrate above a platen on which a polishing pad formed of a light-transmitting polishing pad is disposed on an upper surface thereof and a light source unit is disposed above the polishing pad; an operation of rotating the platen in one direction, and bringing the substrate into contact with the polishing pad; and an operation of supplying a slurry containing photocatalyst particles to the polishing pad, and rotating a polishing head to polish the substrate, wherein the operation of polishing the substrate includes: an operation of forming OH radicals in the slurry, by irradiating light of a wavelength band with which the photocatalytic particles can be excited from the light source toward the polishing pad.

BRIEF DESCRIPTION OF DRAWINGS

The above and other aspects, features, and advantages of the present inventive concept will be more clearly understood from the following detailed description, taken in conjunction with the accompanying drawings, in which.

DETAILED DESCRIPTION

Hereinafter, example embodiments of the present inventive concept will be described with reference to the accompanying drawings. Like numerals refer to like elements throughout.

Figure 1:
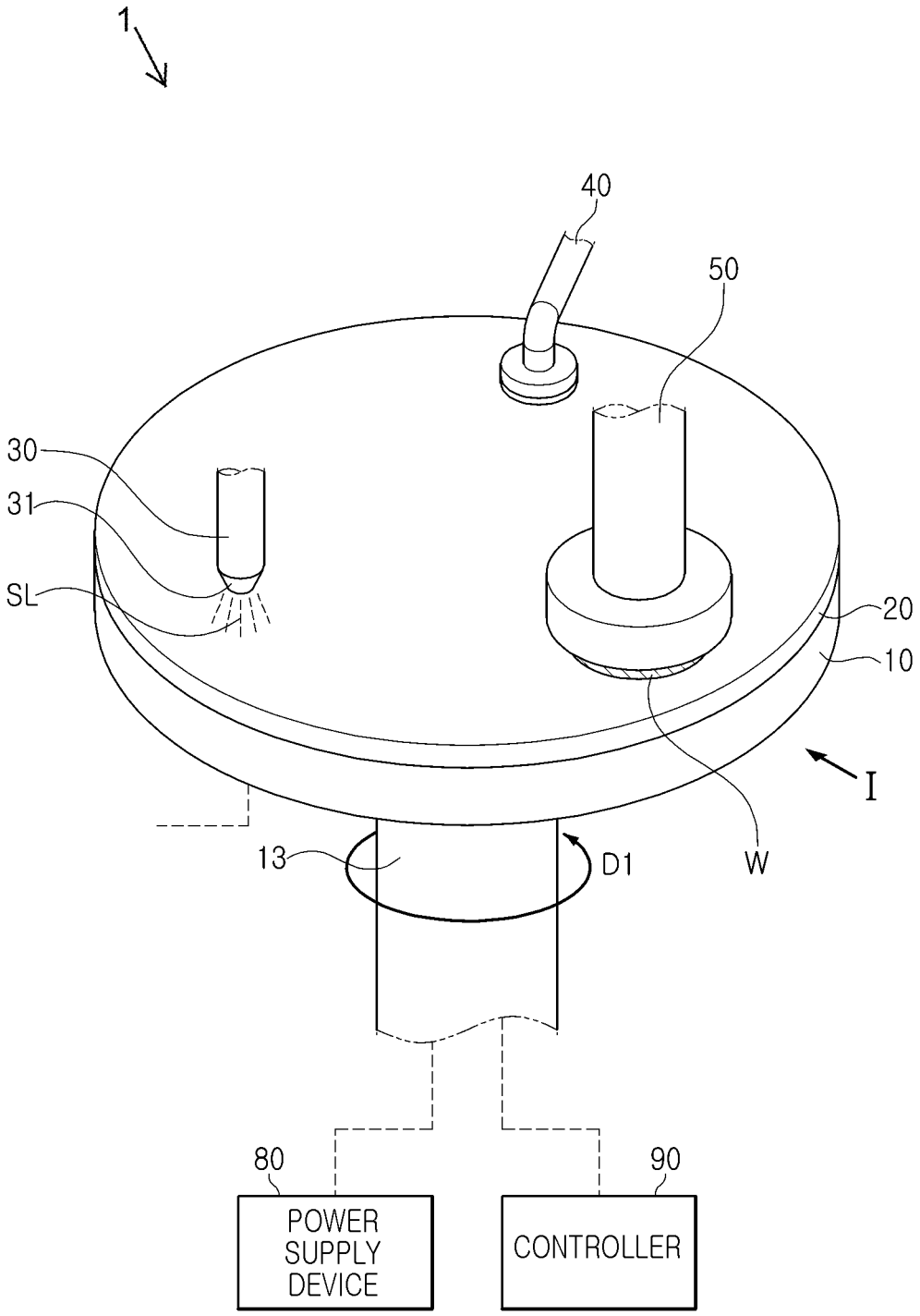
FIG. 1 is a schematic perspective view of a polishing apparatus for a substrate according to an example embodiment of the present inventive concept.

FIG. 1 is a schematic perspective view of a polishing apparatus for a substrate according to an example embodiment of the present inventive concept.

Figure 2:
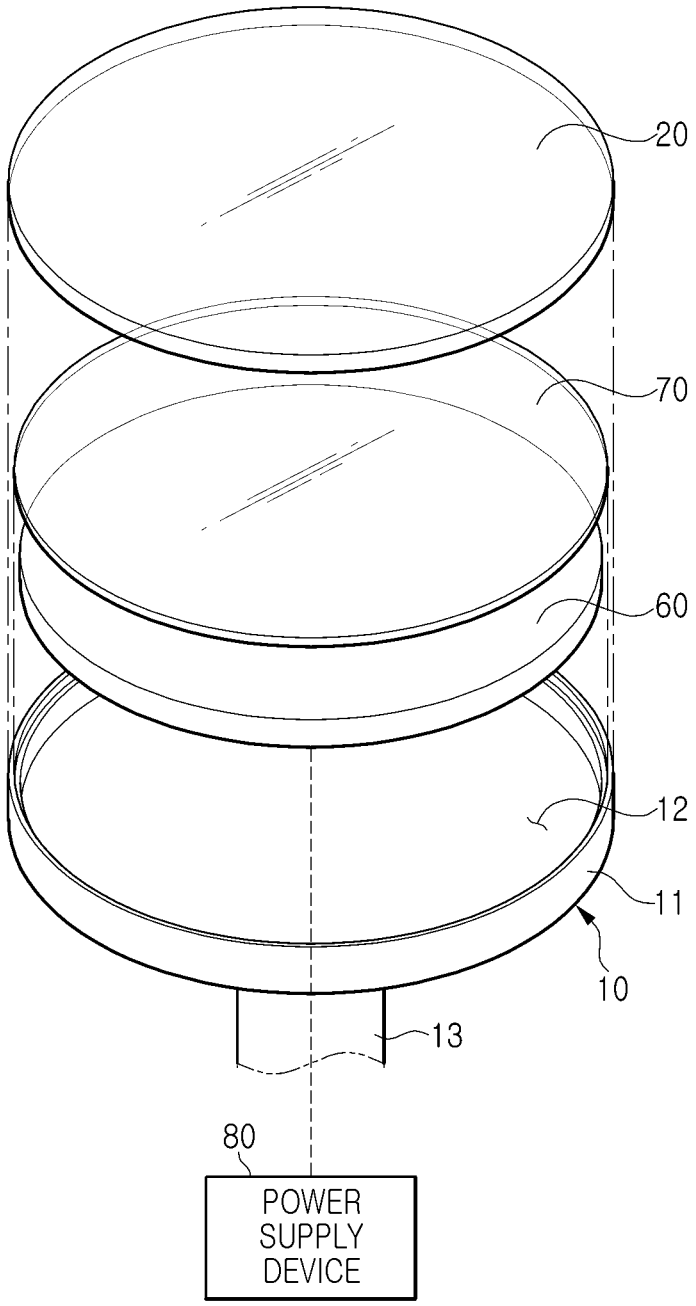
FIG. 2 is an exploded perspective view of the platen of FIG. 1.
Figure 3:
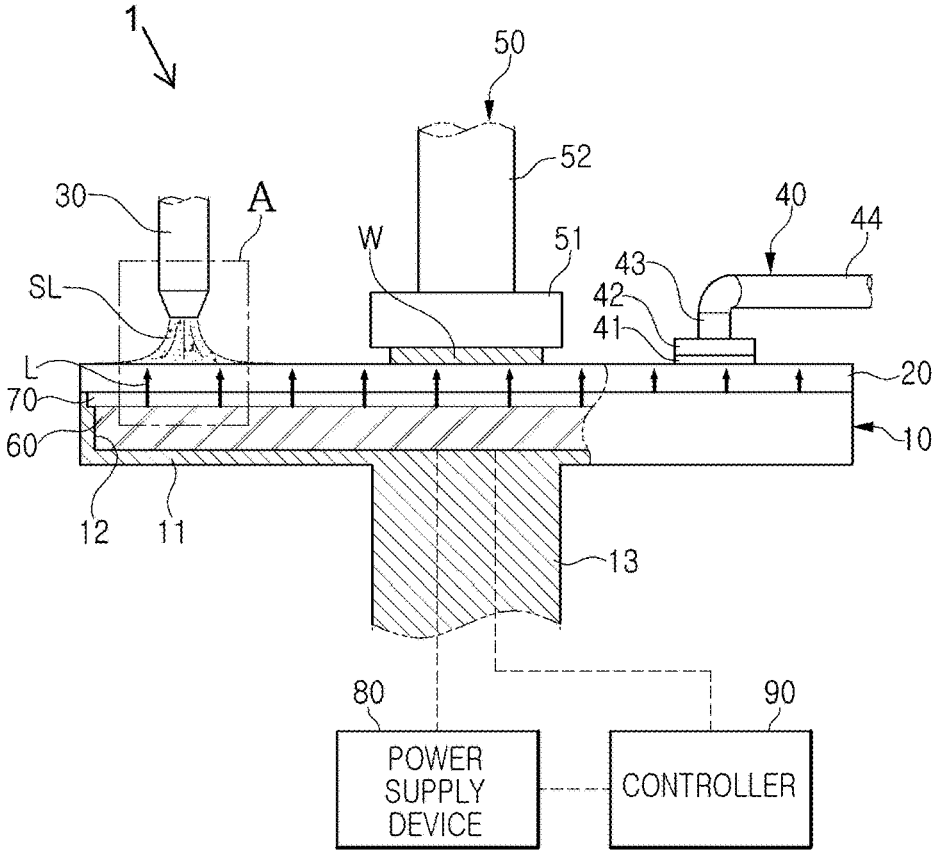
FIG. 3 is a plan view taken in the direction 'I' of FIG. 1.
Figure 4:
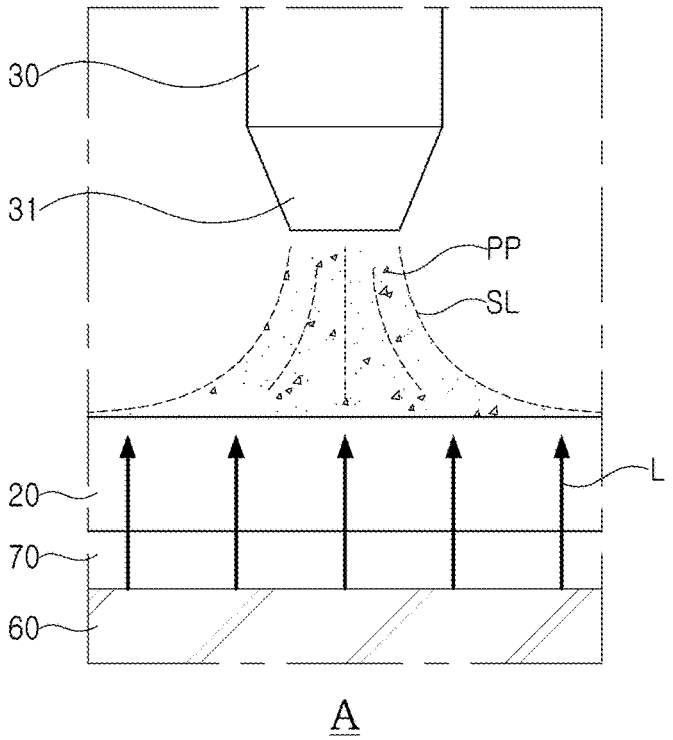
FIG. 4 is an enlarged view of part A of FIG. 3.
Figure 5:
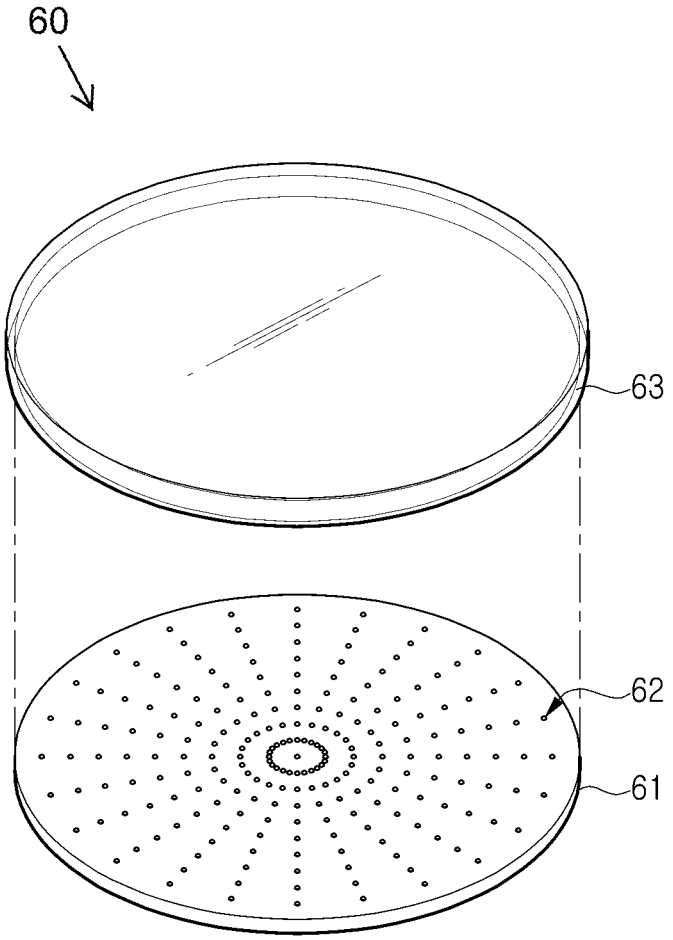
FIG. 5 is an exploded perspective view of the light source unit of FIG. 2.

FIG. 2 is an exploded perspective view of the platen of FIG. 1, and FIG. 3 is a plan view taken in the 'I' direction of FIG. 1. FIG. 4 is an enlarged view of part A of FIG. 3, and FIG. 5 is an exploded perspective view of the light source unit of FIG. 2.

Referring to FIGS. 1 and 2, a polishing apparatus 1 for a semiconductor substrate W may include a platen 10, a slurry supply unit 30, a polishing head 50, a conditioner 40, and a light source unit 60. In addition, the polishing apparatus 1 may include a power supply device 80 for supplying power to the light source unit 60, and a controller 90 for controlling the polishing apparatus 1. The slurry supply unit 30, the polishing head 50, and the conditioner 40 may be sequentially disposed in one direction D1, a rotational direction of the platen 10. The polishing apparatus 1 according to an example embodiment may be used in a process of chemical mechanical polishing a semiconductor substrate W such as a wafer.

The platen 10 may support the polishing pad 20 disposed on an upper surface thereof, and provide a space in which the light source unit 60 is accommodated. The platen 10 may have a disk-shaped body portion 11. A groove portion 12 in which the light source unit 60 is accommodated may be formed on an upper surface of the body portion 11. A rotating shaft 13 rotating in one direction D1 may be connected to a lower surface of the body portion 11 by a driving device such as a motor, so that the platen 10 may be rotated in one direction D1. The platen 10 may rotate clockwise or counterclockwise about the rotating shaft 13. According to an example embodiment, a case in which the platen 10 rotates in a counterclockwise direction will be described as an example.

The light source unit 60 may be accommodated in the groove portion 12 of the platen 10. Accordingly, light L may be emitted by being rotated in the same direction as the rotational direction of the platen 10. The light source unit 60 may emit the light L toward the polishing pad 20 disposed on an upper surface of the platen 10.

Referring to FIG. 5, the light source unit 60 may include a circuit board 61, a light source 62, and a lens unit 63. The light source unit 60 may operate by power supplied from the power supply device 80. The light source 62 may emit light L of a wavelength band capable of causing photo-excitation in photocatalyst particles PP contained in a slurry SL. The wavelength band of the light L emitted from the light source unit 60 may vary depending on the type of the photocatalyst particles PP contained in the slurry SL. For example, when the photocatalyst particles PP are photo-excited by visible light, the light source unit 60 may be provided to emit visible light. In addition, when the photocatalyst particles PP are photo-excited by ultraviolet rays, the light source unit 60 may be provided to emit ultraviolet rays.

The light source 62 may emit visible light or ultraviolet light. For example, the light source 62 may emit ultraviolet light of 234 nm to 365 nm. As the light source 62, various members emitting light, such as, for example, a light emitting diode and a light bulb, may be employed. The light source 62 may be disposed on an upper surface of the circuit board 61. The lens unit 63 may cover the circuit board 61 to block an inflow of external substances, and may adjust an optical path of light emitted from the light source 62. The lens unit 63 may allow light L emitted from the light source unit 60 to shine on a specific region of the polishing pad 20 by adjusting the optical path so that the light emitted from the light source 62 faces upwardly of the platen 10.

According to an example embodiment, a light-transmitting cover 70 covering the light source unit 60 may be disposed. The light-transmitting cover 70 may cover an upper surface of the light source unit 60 to prevent the light source unit 60 from being damaged by a chemical material such as the slurry SL permeated thereinto through the polishing pad 20. For example, the light-transmitting cover 70 may contact the upper surface of the light source unit 60, preventing the chemical material such as the slurry SL from contacting the light source unit 60.

The light-transmitting cover 70 may be formed of a material having high light transmittance. For example, the light-transmitting cover 70 may be formed of at least one of soft glass, fused silica, and fused quartz.

The polishing pad 20 may have a disk shape, and the polishing pad 20 may be disposed on the upper surface of the platen 10 to cover the light source unit 60. The upper surface of the polishing pad 20 may serve as a polishing surface for polishing the semiconductor substrate W.

The polishing pad 20 may be formed of a light-transmitting material. For example, the polishing pad 20 may be formed of a transparent material such as light-transmitting polyurethane (poly-urethane). Accordingly, the photocatalyst particles PP of the slurry SL may be photo-excited by the light of the light source unit 60 emitted through the polishing pad 20.

The slurry supply unit 30 may be disposed on the polishing pad 20 to be spaced apart from the polishing head 50. In addition, the slurry supply unit 30 may be disposed to be spaced apart from a front end of the conditioner 40 in one direction D1. The slurry supply unit 30 may include at least one nozzle 31, and may spray a slurry SL including photocatalyst particles PP on a surface of the polishing pad 20 through the nozzle 31.

The slurry SL sprayed from the slurry supply unit 30 may be excited by light of a predetermined wavelength band emitted from the light source unit 60. The light in the predetermined band may be visible light or ultraviolet light. For example, light of a predetermined wavelength band may be ultraviolet light including a wavelength range of 234 nm to 365 nm. The slurry SL may include photocatalyst particles PP excited by light of a specific band and water. The slurry SL may include a separate abrasive together with the photocatalyst particles PP. In addition, according to an example embodiment, the photocatalyst particles (PP) may be used as an abrasive.

When the light source unit 60 emits visible light, the photocatalyst particles PP may include one or more of $Au/TiO_2$, $TiO_2/SeO_2$, and $TiO_2/SiO_2$, and mixtures thereof. In addition, when the light source unit 60 emits ultraviolet light, the photocatalyst particles PP may include one or more of $TiO_2$, ZnO, $ZrO_2$, CdSe, $WO_3/TiO_2$, and $Al_2O_3/ZrO_2$, and mixtures thereof. The photocatalyst particles may be excited by light in a specific band, and the excited energy may decompose water contained in the slurry SL to generate reactive OH radicals. Since a chemical reaction rate of the slurry SL varies depending on an amount of reactive OH radicals generated, a polishing rate of the CMP process can be adjusted by adjusting the amount of reactive OH radicals generated.

The slurry SL sprayed from the slurry supply unit 30 may be used to polish a surface of the semiconductor substrate W by the polishing head 50, and then may be discharged externally of the platen 10. According to an example embodiment, in the slurry supply unit 30, the slurry SL may be sprayed in a heated or cooled state. The slurry SL supplied from the slurry supply unit 30 may react with the surface of the semiconductor substrate W attached to the polishing head 50 to perform a chemical mechanical polishing process.

Referring to FIGS. 1 and 3, the conditioner 40 may be disposed on the polishing pad 20 to be spaced apart from the polishing head 50. In addition, the conditioner 40 may be disposed between the polishing head 50 and the slurry supply unit 30 in one direction D1. Referring to FIG. 3, the conditioner 40 may perform a conditioning process for finely polishing a surface of the polishing pad 20 with a conditioning disk 41 to which diamond particles are attached in order to modify surface roughness of the polishing pad 20. The conditioning process may be performed periodically to make the surface roughness of the polishing pad 20 uniform. The conditioner 40 may include a conditioning disk 41 and a disk holder 42 for supporting the conditioning disk 41. The disk holder 42 may have a rotating shaft 43 connected thereabove to be rotated by a driving device such as a motor. An arm 44 for reciprocating the conditioning disk 41 in both left and right directions may be disposed at one end of the rotating shaft 43.

Referring to FIGS. 1 and 3, the polishing head 50 may be disposed above the polishing pad 20 to be spaced apart from a rear end of the slurry supply unit 30 in one direction D1. In addition, the polishing head 50 may be disposed at a front end of the conditioner 40 with respect to one direction D1. A semiconductor substrate W to be chemically and mechanically polished may be attached to a lower portion of the polishing head 50 by vacuum. The polishing head 50 may include a substrate holder 51 for holding the semiconductor substrate W and a shaft 52. The shaft 52 may move the substrate holder 51 in a horizontal direction or rotate the substrate holder 51 in the horizontal direction by a driving device such as a motor. The polishing head 50 may apply a constant polishing load to the semiconductor substrate W to adhere the semiconductor substrate W to the polishing pad 20, and be rotated to chemically and mechanically polish a surface of the semiconductor substrate W. In addition, according to an example embodiment, the polishing head 50 may reciprocate together with the rotational movement on the polishing pad 20.

The controller 90 may control an overall operation of the polishing apparatus 1. For example, the controller 90 may control an amount of light L emitted from the light source unit 60, a rotational speed of the platen 10, a flow rate per unit time of the slurry SL supplied from the slurry supply unit 30, and the like. The controller 90, for example, may be implemented with at least one processor such as a central processing unit (CPU), a graphics processing unit (GPU), a microprocessor, an application specific integrated circuit (ASIC), a field programmable gate arrays (FPGA), and the like, and may be provided with a memory (e.g., random access memory (RAM), read only memory (ROM), storage media, etc.) for storing various data necessary for the operation of the polishing apparatus 1 (e.g., data, information, computer program instructions, etc.). For example, the at least one processor may be configured to execute computer program instructions stored in the memory and to thereby perform various processes and methods disclosed herein. For example, the controller 90 may be configured to perform the processes and methods described herein, with such processes and methods implemented in hardware, software, firmware, or any combination thereof. If implemented in software, the functions can be stored as one or more instructions or code on computer-readable medium, including the memory described above. The controller 90 may control an amount of OH radicals generated from the photocatalyst particles PP of the slurry SL, by controlling the power supplied from the power supply device 80 to the light source unit 60. Thereby, the controller 90 may control a polishing rate of the CMP process.

Next, various modifications of the polishing apparatus for a substrate according to example embodiments will be described with reference to FIGS. 6A to 10B.

Hereinafter, the platen, the light source unit, and the polishing pad, which are different from the example embodiment of FIG. 1, will be mainly described, and a detailed description of the slurry supply unit 30, the slurry supply unit 30, the polishing head 50, and the conditioner 40, which was disposed above the polishing pad 20 in the example embodiment of FIG. 1 described above, will be omitted.

Figure 6A:
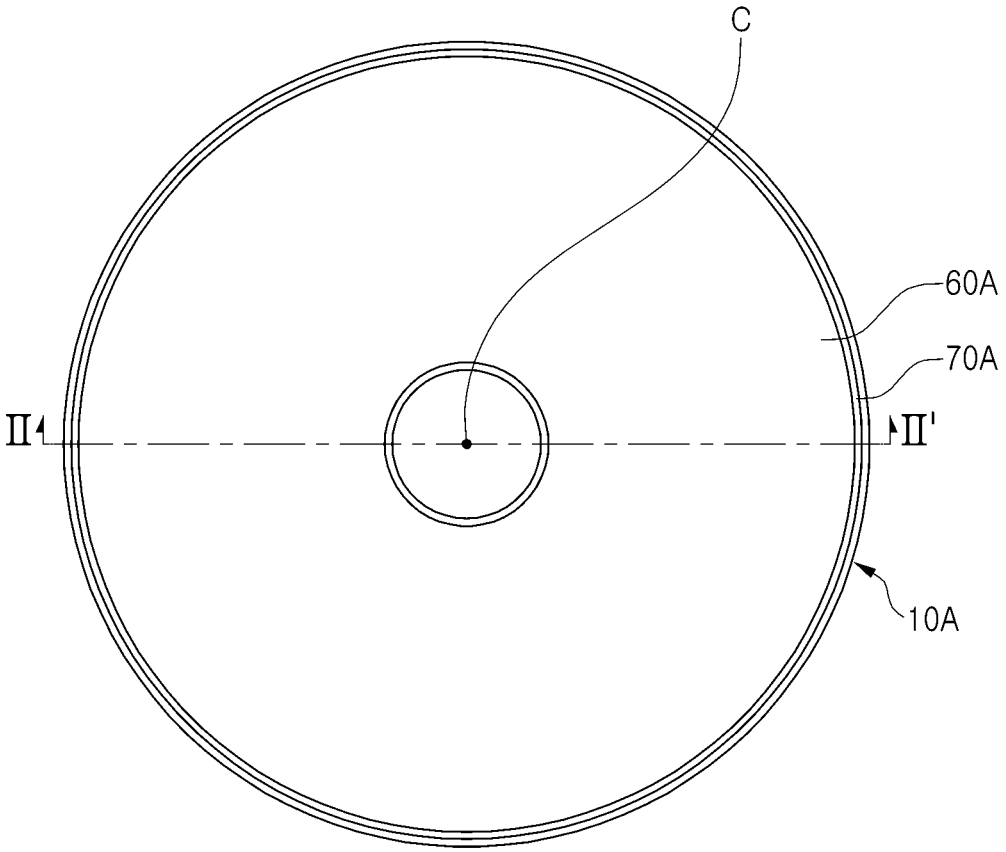
FIGS. 6A to 10B illustrate various modifications applicable to the polishing apparatus for a substrate according to example embodiments.
Figure 6B:
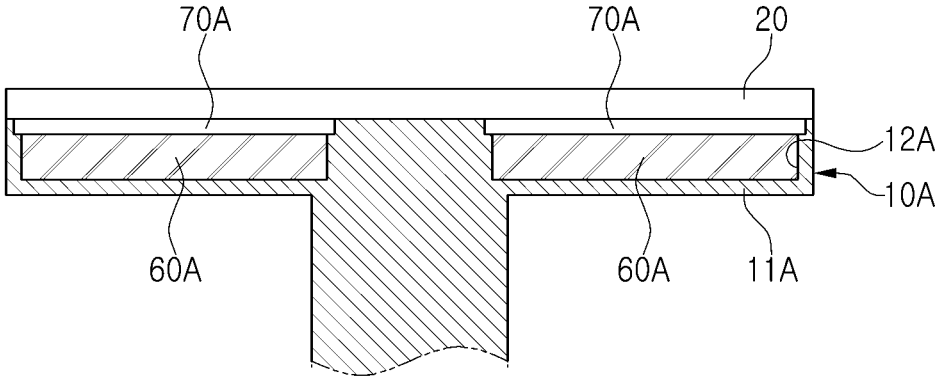

FIG. 6A is a plan view of the platen 10A according to an example embodiment, and FIG. 6B is a cross-sectional view taken along the line II-II' of FIG. 6A. In an example embodiment, as compared to the example embodiment described above, there is a difference in that the light source unit 60A has a ring shape, and there is a difference in that the groove portion 12A formed in the body portion 11A and a light-transmitting cover 70A are also formed to have a ring shape to correspond to the light source unit 60A. For example, a center portion of the body portion 11A may horizontally overlap the light-transmitting cover 70A and the light source unit 60A, and may contact a lower surface of the polishing pad 20. A center of the center portion of the body portion 11A may be aligned with the center C of the platen 10A. As compared to the above-described embodiment, it is possible to prevent light emitted from the light source unit 60A from being unnecessarily emitted to the center C of the platen 10A.

Figure 7A:
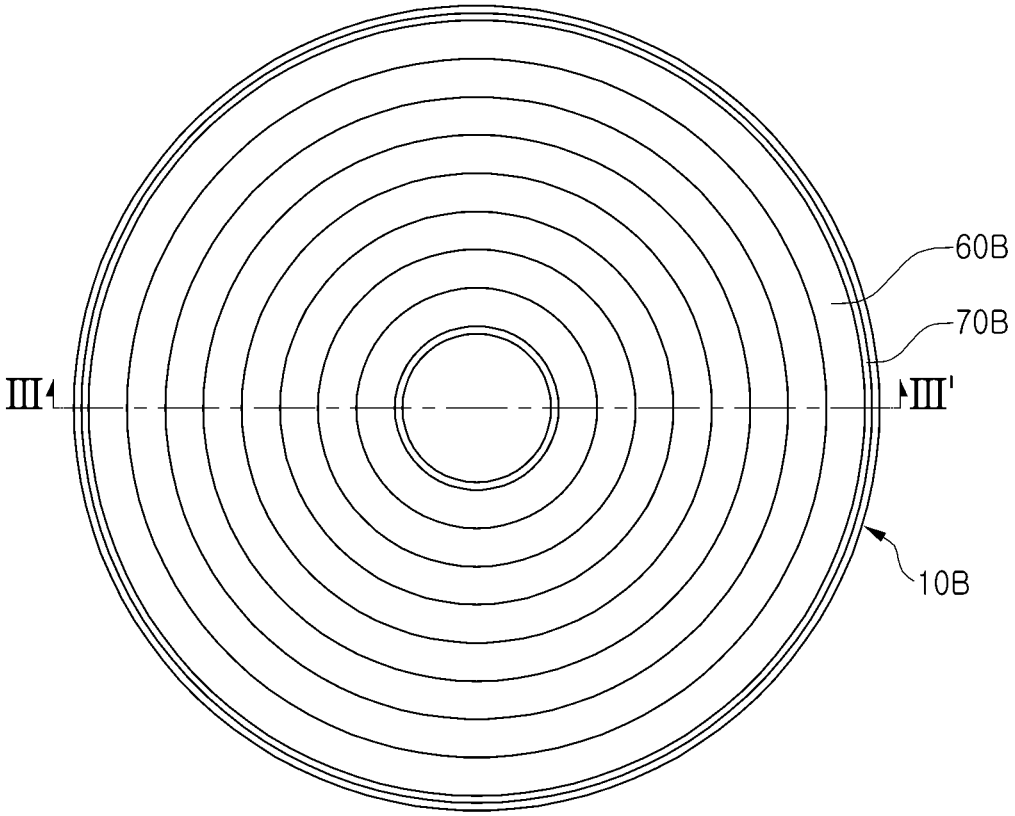
Figure 7B:
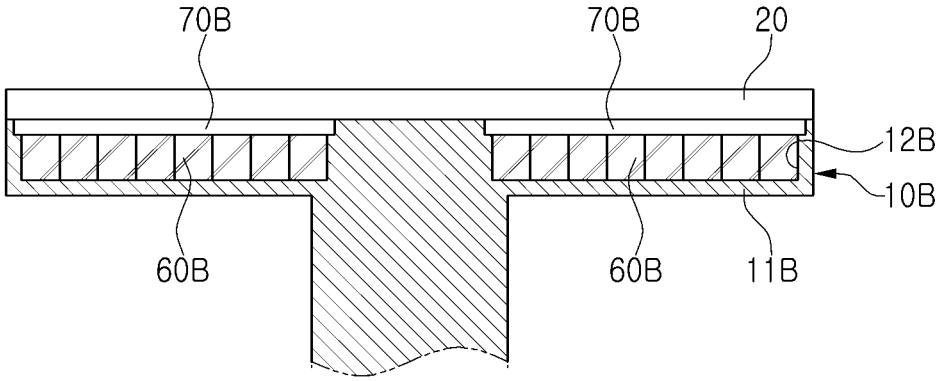

FIG. 7A is a plan view of the platen 10B according to an example embodiment, and FIG. 7B is a cross-sectional view taken along the line III-III' of FIG. 7A. In an example embodiment, as compared to the above-described embodiment, there is a difference in that the light source unit 60B has a ring shape, and the groove portion 12B formed in the body portion 11B and a light-transmitting cover 70B is also formed to have a ring shape to correspond to the light source unit 60B. For example, a center portion of the body portion 11B may horizontally overlap the light-transmitting cover 70B and the light source unit 60B, and may contact a lower surface of the polishing pad 20. A center of the center portion of the body portion 11B may be aligned with the center C of the platen 10A. In addition, in an example embodiment, as compared to the embodiment described above, there is a difference in that a plurality of light source units 60B are employed. Each of the plurality of light source units 60B may be formed in a ring shape having a center common to a center of the platen 10B, and the plurality of light source units 60B may be arranged concentrically with respect to the center of the platen 10B. In addition, each of the plurality of light source units 60B may emit light having different amounts of light.

Figure 8A:
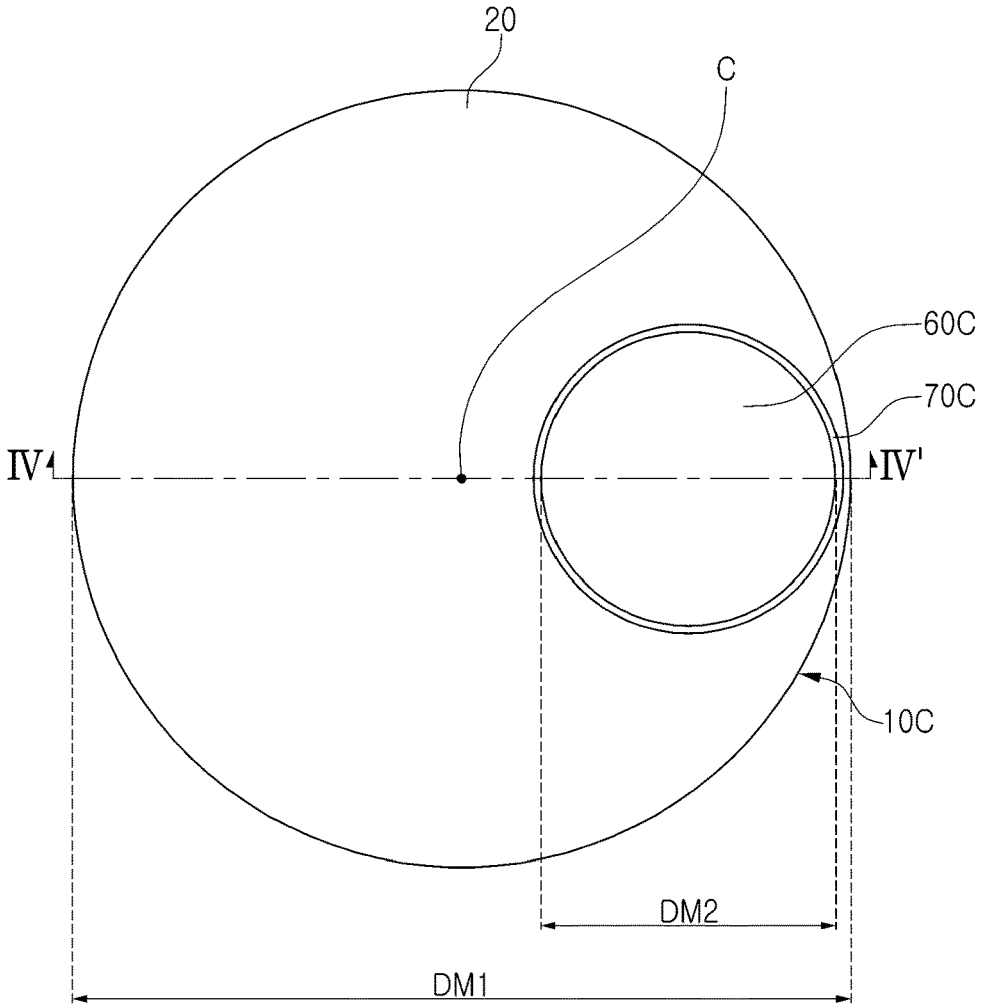
Figure 8B:
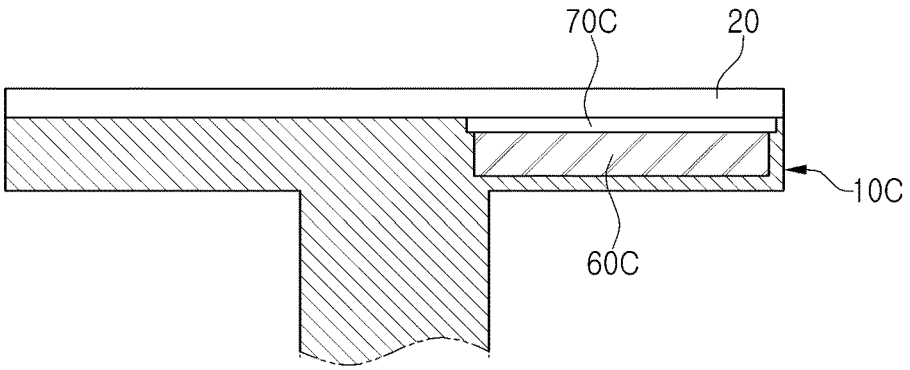

FIG. 8A is a plan view of a platen 10C according to an example embodiment, and FIG. 8B is a cross-sectional view taken along the line IV-IV' of FIG. 8A. In an example embodiment, as compared to the above-described example embodiment, there is a difference in that a diameter DM2 of the light source unit 60C is smaller than the diameter DM1 of the platen 10C, and a light-transmitting cover 70C is also reduced in size to correspond to the light source unit 60C. As the size of the light source unit 60C is reduced, power consumed by the light source unit 60C may be reduced. In an example embodiment, the light source unit 60C according to an example embodiment may be disposed so that a center thereof is offset with respect to a center C of the platen 10C. For example, the light source unit 60C may not overlap the center C of the platen 10C. As the platen 10C rotates, light emitted from the light source unit 60C has the same effect as irradiating a kind of pulse to the slurry SL. Accordingly, by controlling a rotational speed of the platen 10C, an amount of light irradiated to the photocatalyst particles PP of the slurry SL may be precisely controlled.

Figure 9A:
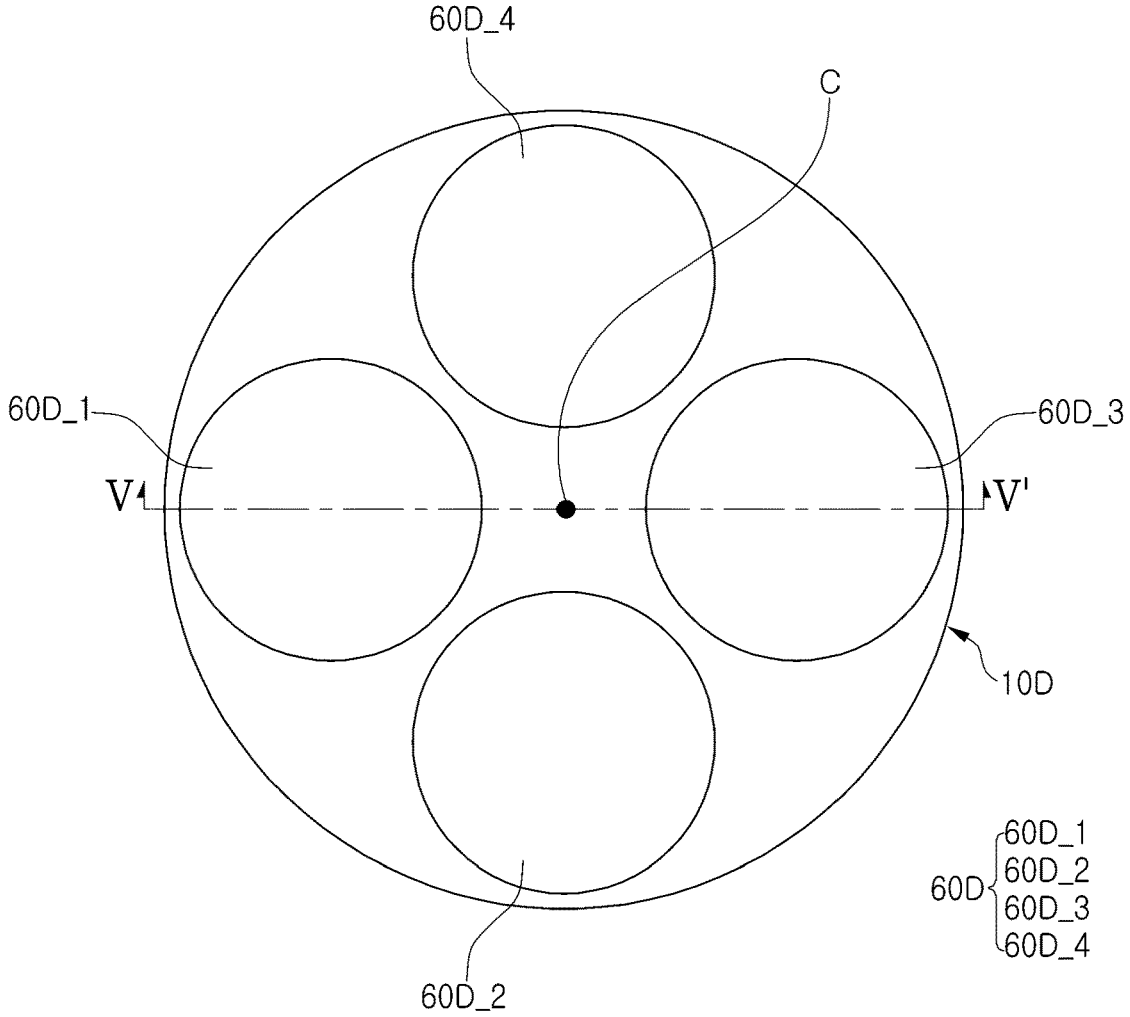
Figure 9B:
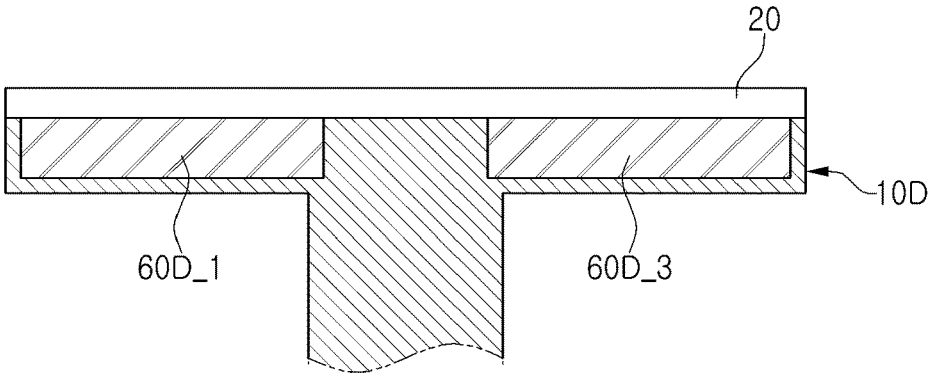

FIG. 9A is a plan view of the platen 10D according to an example embodiment, and FIG. 9B is a cross-sectional view taken along the line V-V' of FIG. 9A. In an example embodiment, as compared to the example embodiment described above, there is a difference in that a light source unit 60D includes first to fourth light source units 60D_1, 60D_2, 60D_3, and 60D_4, and there is a difference in that a light-transmitting cover is omitted, so that it is disposed to be in direct contact with the polishing pad 20 and the light source unit 60D. The first to fourth light source units 60D_1, 60D_2, 60D_3, and 60D_4 may surround the center C of the platen 10D. For example, the first to fourth light source units 60D_1, 60D_2, 60D_3, and 60D_4 may be provided such that none of the first to fourth light source units 60D_1, 60D_2, 60D_3, and 60D_4 overlaps the center C of the platen 10D.

Figure 10A:
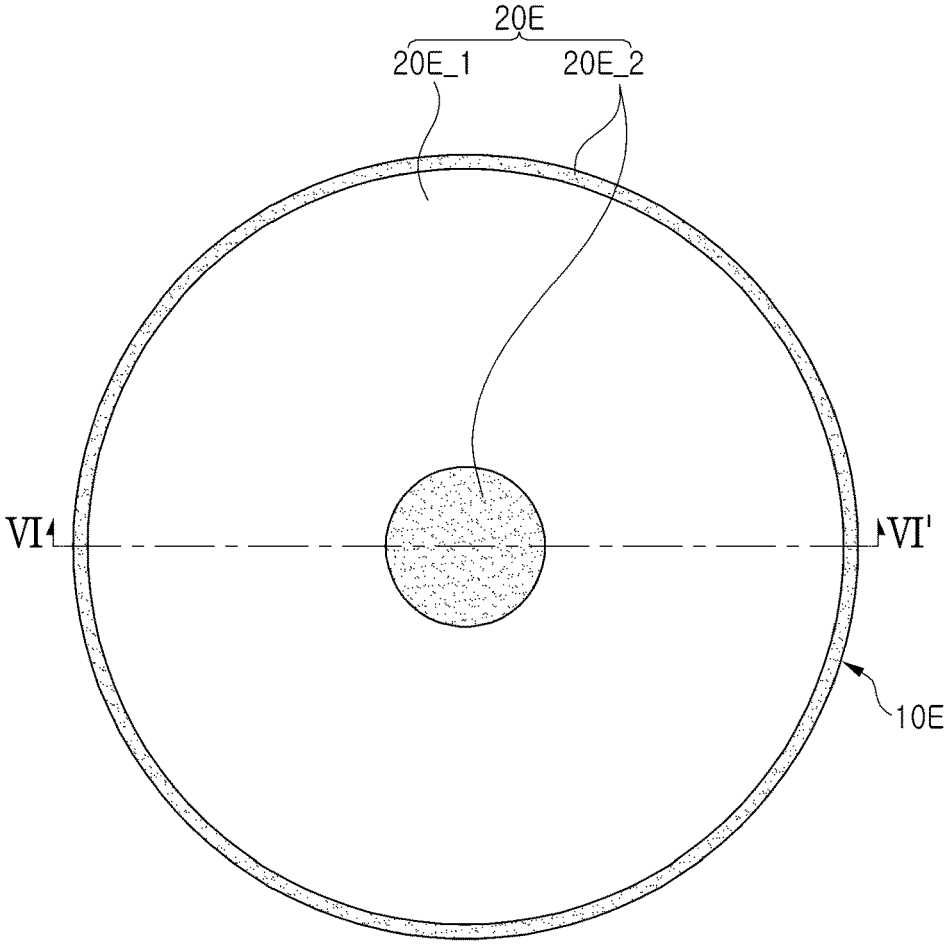
Figure 10B:
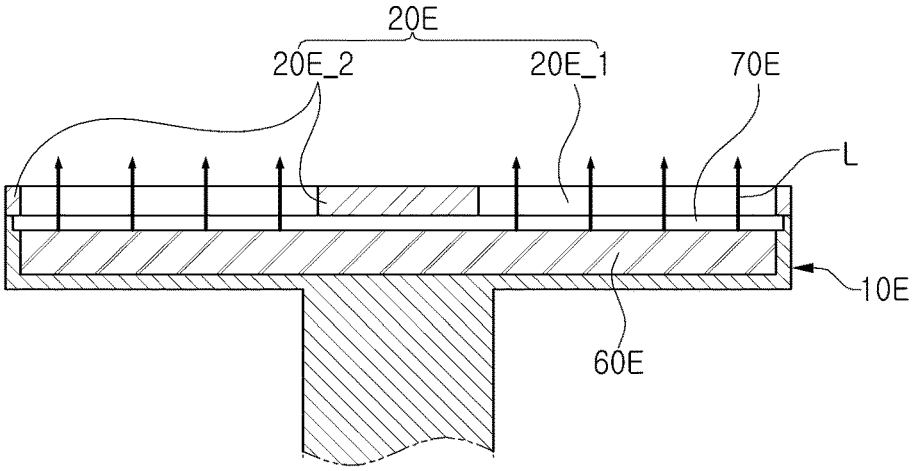

FIG. 10A is a plan view of a platen 10E according to an example embodiment, and FIG. 10B is a cross-sectional view taken along the line VI-VI' of FIG. 10A. In an example embodiment, as compared to the example embodiment described above, there is a difference in that a polishing pad 20E includes a first region 20E_1 and a second region 20E_2 having different light transmittances. In an example embodiment, the first region 20E_1 may be formed of a material having high light transmittance, and the second region 20E_2 may be formed of a material having relatively low light transmittance. For example, the first region 20E_1 may be formed of a material having high light transmittance, and the second region 20E_2 may be formed of a material having low light transmittance to an extent that light does not pass therethrough. Accordingly, light L emitted from the light source unit 60E may be emitted only through the first region 20E_1. Therefore, if necessary, by replacing the polishing pad 20E, a region to which the light L emitted from the light source unit 60E is irradiated may be changed. According to an example embodiment, the first region 20E_1 may be formed in a ring shape to surround the second region 20E_2, but the present inventive concept is not limited thereto, and the size and position of the first region 20E_1 may be changed.

Figure 11:
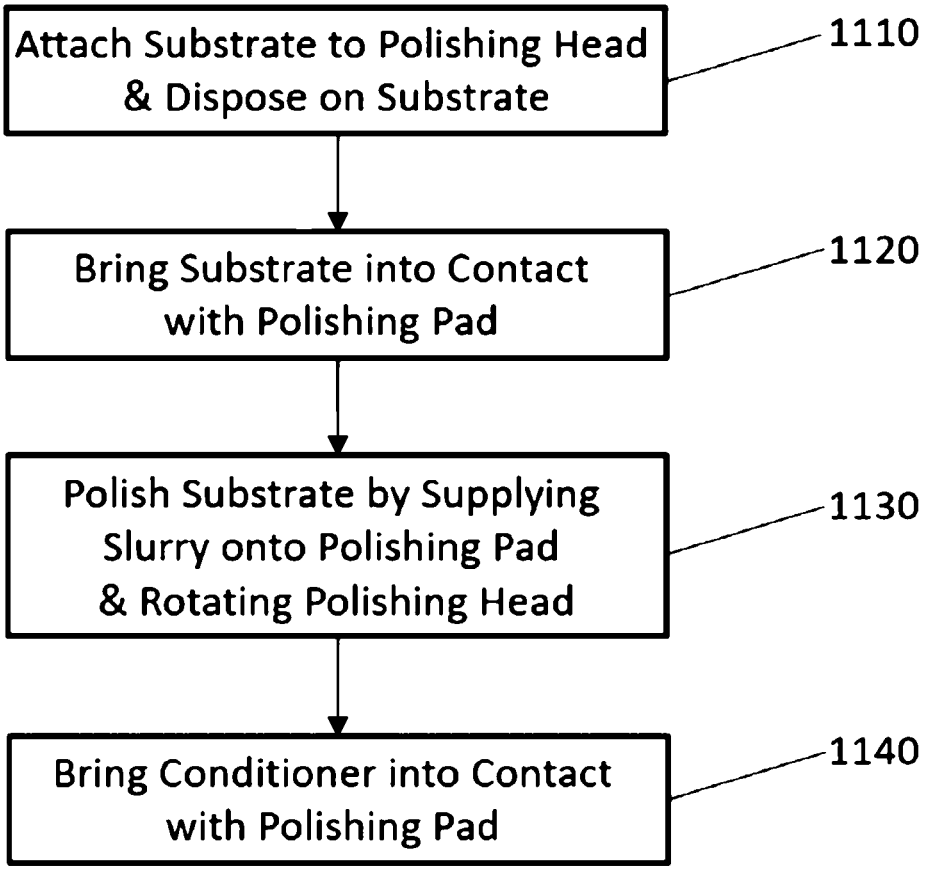
FIG. 11 is a flowchart illustrating a polishing method for polishing a substrate according to example embodiments.

FIG. 11 is a flowchart illustrating a polishing method for polishing a substrate according to example embodiments The polishing method for a substrate of an example embodiment may be performed using the polishing apparatus 1 of FIG. 1. Since the polishing apparatus 1 of FIG. 1 has been described above, a detailed description thereof will be omitted.

First, a semiconductor substrate W may be attached to a polishing head 50 of the polishing apparatus 1 and disposed on the platen 10 (step 1110).

Next, the semiconductor substrate W may be brought into contact with a polishing pad 20 rotating in one direction D1 (step 1120).

Next, the semiconductor substrate W may be polished by supplying a slurry SL containing photocatalyst particles PP onto the polishing pad 20, and rotating the polishing head 50 (step 1130). In this case, light L of a wavelength band with which the photocatalyst particles PP can be excited may be emitted from the light source unit 60 toward the polishing pad 20 to form OH radicals in the slurry SL.

Next, a conditioner 40 may be brought into contact with the polishing pad 20 to condition a surface of the polishing pad 20 (step 1140).

The above-described polishing apparatus and polishing method may be used to manufacture semiconductor devices including logic devices and memory devices, and further processes may be performed on the semiconductor substrate W to form the semiconductor devices. For example, additional conductive and insulating layers may be deposited on the semiconductor substrate W to form a plurality of semiconductor chips, and the semiconductor chips may then be singulated, packaged on a package substrate, and encapsulated by an encapsulant to form a semiconductor package. The semiconductor devices may include finFET, DRAM, VNAND, etc. The semiconductor devices may be applied in various systems, such as a computing systems.

As set forth above, in the polishing apparatus for a substrate and the polishing method for a substrate according to an example embodiment of the present inventive concept, a polishing rate of a CMP process may be adjusted, by adjusting light irradiated to a slurry containing photocatalyst particles.

Various and advantageous advantages and effects of the present inventive concept is not limited to the above description, it will be more readily understood in the process of describing the specific embodiments of the present inventive concept.

While the example embodiments have been shown and described above, it will be apparent to those skilled in the art that modifications and variations could be made without departing from the scope of the present inventive concept as defined by the appended claims.

What is claimed is:

1. A polishing apparatus for a substrate, comprising:

a polishing pad formed of a light-transmitting material;

a platen on which the polishing pad is disposed on an upper surface thereof, the platen having a groove portion in a region overlapping the polishing pad, and being rotatably installed in one direction;

a slurry supply unit comprising at least one nozzle and configured to supply a slurry containing photocatalyst particles excited by light of a predetermined wavelength band to the polishing pad;

a light source accommodated in the groove portion of the platen, and configured to emit the light of the predetermined wavelength band;

a light-transmitting cover covering the light source and contacting an upper surface of the light source;

a conditioner installed on the polishing pad to be spaced apart from the slurry supply unit in the one direction, and configured to polish a surface of the polishing pad; and a polishing head installed on the polishing pad to be spaced apart from the conditioner in the one direction, and configured to rotate the substrate in contact with the polishing pad, wherein the upper surface of the light-transmitting cover is at the same level as an upper surface of the platen, and wherein a lower surface of the polishing pad contacts an upper surface of the light-transmitting cover and the upper surface of the platen, wherein the light source has a disk shape having a first diameter, wherein the light-transmitting cover has a disk shape having a second diameter larger than the first diameter, and wherein the platen has a disk shape having a third diameter larger than the second diameter.

2. The polishing apparatus of claim 1, wherein the light source is configured to emit ultraviolet light having a wavelength range of 234 nm to 365 nm.

3. The polishing apparatus of claim 2, wherein the photocatalyst particles include one or more of $TiO_2$, ZnO, $ZrO_2$, CdSe, $WO_3/TiO_2$, and $Al_2O_3/ZrO_2$, and mixtures thereof.

4. The polishing apparatus of claim 1, wherein the light source is configured to emit visible light.

5. The polishing apparatus of claim 4, wherein the photocatalyst particles include one or more of $Au/TiO_2$, $TiO_2/SeO_2$, and $TiO_2/SiO_2$, and mixtures thereof.

6. The polishing apparatus of claim 1, wherein the slurry further comprises an abrasive.

7. The polishing apparatus of claim 1, wherein the photocatalyst particles are an abrasive of the slurry.

8. The polishing apparatus of claim 1, wherein the light source comprises a plurality of light source elements, wherein each of the plurality of light source elements has a ring shape having a center common to a center of the platen, and wherein the plurality of light source elements are arranged concentrically.

9. The polishing apparatus of claim 8, wherein each of the plurality of light source elements is configured to emit different amounts of light.

10. The polishing apparatus of claim 1, wherein the light-transmitting cover comprises at least one of soft glass, fused silica, and fused quartz.

11. The polishing apparatus of claim 1, further comprising:

a power supply configured to apply power to the light source; and a controller configured to control the power applied by the power supply to the light source to adjust an amount of the OH radicals generated from the photocatalyst particles in the slurry.

12. A polishing apparatus for a substrate, comprising:

a polishing pad having at least one region formed of a light-transmitting material;

a platen on which the polishing pad is disposed on an upper surface thereof, the platen having a groove portion in a region overlapping the polishing pad, and being rotatably installed in one direction;

a light source accommodated in the groove portion of the platen, and configured to emit light of a predetermined wavelength band to the at least one region of the polishing pad;

a light-transmitting cover covering the light source and contacting an upper surface of the light source;

a slurry supply unit comprising at least one nozzle and configured to supply a slurry containing photocatalyst particles excited by the light of the predetermined wavelength band to the polishing pad; and a polishing head installed on the polishing pad to be spaced apart from the slurry supply unit in the one direction, and configured to rotate the substrate in contact with the polishing pad, wherein the upper surface of the light-transmitting cover is at the same level as an upper surface of the platen, and wherein a lower surface of the polishing pad contacts an upper surface of the light-transmitting cover and the upper surface of the platen, wherein the light source has a disk shape having a first diameter, wherein the light-transmitting cover has a disk shape having a second diameter larger than the first diameter, and wherein the platen has a disk shape having a third diameter larger in the second diameter.

13. The polishing apparatus of claim 12, wherein the polishing pad is entirely formed of a light transmitting material.

14. The polishing apparatus of claim 12, wherein the polishing pad comprises a first region and a second region, having different light transmittances, and wherein the first region is the at least one region.

15. The polishing apparatus of claim 12, wherein, in the slurry, when the light of the predetermined wavelength band is irradiated, the photocatalyst particles are excited to generate OH radicals.

16. A polishing apparatus for a substrate, comprising:

a platen on which a polishing pad formed of a light-transmitting material is disposed on an upper surface thereof, and rotatably installed in one direction;

a light source accommodated in a groove portion formed on an upper surface of the platen, and configured to emit light of a predetermined wavelength band toward the polishing pad;

a light-transmitting cover covering the light source and contacting an upper surface of the light source; and a slurry supply unit comprising at least one nozzle and configured to supply a slurry containing photocatalyst particles excited by the light of the predetermined wavelength band to the polishing pad, wherein the upper surface of the light-transmitting cover is at the same level as an upper surface of the platen, and wherein a lower surface of the polishing pad contacts an upper surface of the light-transmitting cover and the upper surface of the platen, wherein the light source has a disk shape having a first diameter, wherein the light-transmitting cover has a disk shape having a second diameter larger than the first diameter, and wherein the platen has a disk shape having a third diameter larger than the second diameter.

17. The polishing apparatus of claim 16, wherein, in the slurry, when the light of the predetermined wavelength band is irradiated, the photocatalyst particles are excited to generate OH radicals.

18. The polishing apparatus of claim 17, further comprising:

a power supply device configured to apply power to the light source; and a controller configured to control the power applied by the power supply device to the light source.

19. The polishing apparatus of claim 18, wherein the controller is configured to control the power supplied to the light source to adjust an amount of the OH radicals generated from the photocatalyst particles in the slurry.

* * * * *